United States Patent [19]

Nishizako et al.

[11] Patent Number: 4,471,178

[45] Date of Patent: Sep. 11, 1984

[54] AUXILIARY CIRCUIT BREAKER

[75] Inventors: Shizutaka Nishizako; Naoki Ogawa, both of Nagoya, Japan

[73] Assignee: Mitsubishi Denki Kabushiki Kaisha, Tokyo, Japan

[21] Appl. No.: 355,112

[22] Filed: Mar. 5, 1982

[30] Foreign Application Priority Data

Mar. 16, 1981 [JP] Japan ..... 56-36483

[51] Int. Cl.[3] ..... H01H 15/00

[52] U.S. Cl. ..... 200/16 A

[58] Field of Search ..... 200/16 A, 16 B, 17 R

[56] References Cited

U.S. PATENT DOCUMENTS

| | | | |
|---|---|---|---|
| 2,295,668 | 9/1942 | Krieger | 200/16 A |
| 3,258,548 | 6/1966 | Cartier et al. | 200/16 A |
| 4,029,924 | 6/1977 | Frank et al. | 200/16 A X |

*Primary Examiner*—J. R. Scott

*Attorney, Agent, or Firm*—Oblon, Fisher, Spivak, McClelland & Maier

[57] ABSTRACT

An auxiliary circuit breaker having an auxiliary cross bar which is supported by a cover so that the auxiliary cross bar is actuated by a center cross bar to move a movable contact from a closed state to an open state. The operation of the auxiliary cross bar results in delayed operation of the operation of a normally closed circuit to provide a reliable contact operation of the main circuit breaker.

4 Claims, 15 Drawing Figures

AUXILIARY CIRCUIT BREAKER

BACKGROUND OF THE INVENTION

1. Field of the Invention

Ihe present invention relates to an auxiliary circuit breaker. More particularly, it relates to an auxiliary circuit breaker mechanically interlocked with the switching operation of a main circuit of electric devices such as low or high voltage electromagnetic contactors or various type of circuit breakers.

2. Description of the Prior Art

Ihe conventional auxiliary circuit breaker will be described with reference to FIGS. 1 to 6.

In FIG. 1, a base (1) formed by plastic molding includes six chambers (2) which are insulated from each other. Each chamber contains a switching element, partition barriers (3), ('3) for insulating each chamber, a window (4) and fitting holes (5), (5'). FIG. 2 illustrates in detail base (1) in which a first stopper (7) and a second stopper (8) are formed so as to limit the movement of a cross bar (6) which is located at the center of the base (1) and is movable along the longitudinal axis of the base. The base also includes a stationary contact (20), (20') in each chamber (2). The cross bar, formed by plastic molding, has six rectangular holes (10) with which a movable contact engages, an elongated rectangular hole (11) at the lower portion, a seat (12) for a spring (17), which seat (12) is formed at the bottom of the hole (11), a first projection (13) which is brought into contact with the first stopper (7), and a second projection (14) which is brought into contact with the second stopper (8) of the base (1). A known spring (15) for the contact and a spring washer (16) are held in the rectangular hole (10). The movable contact is placed at a lower position in case of a normally closed contact system (which occupy three positions from the bottom of the base shown in FIG. 1) and is placed at an upper position in the case of normally open contact system (three positions from the top of the base shown in FIG. 1). The releasing spring (17) and a cover holder (18) acting as a seat for the spring are provided at the rectangular hole (11) formed at the lower portion of the cross bar (6). The base (1) is covered by a dust-proof cover (19) made of a transparent plastic material.

FIGS. 1 and 2 show stationary contact (20), (20') schematically. FIG. 3 shows the stationary contact (20) in detail in which it is formed by bending a metal sheet to provide three portions. A contact point (21) is bonded on the central portion and a threaded hole (22) is formed in one side of the stationary contact. The stationary contact is fitted into a seat (9) of the base (1) by utilizing its own spring action and screws (23), (23') serving as output terminals (FIG. 1) are screwed into the threaded hole (22), thus the movement of the stationary contact in the transverse direction in FIG. 1 is prevented.

In the structure described above, the cross bar (6) is normally pressed down by the releasing spring (17) to the stop position which makes the top of the elongated rectangular hole (11) of the cross bar (6) contact with the cover holder (18). The conventional auxiliary circuit breaker is adapted to cooperate mechanically with the switching operation of a main circuit breaker (not shown). The main circuit breaker is mainly of a DC magnet-saving resistor type meeting the demands of reduction of shock on switching, long life and minaturization of an electromagnet.

FIG. 5 illustrates a circuit diagram of the main circuit breaker wherein the symbol MC designates the coil of the main circuit breaker, (MC-b) designates the normally closed contact of an auxiliary circuit breaker which has a greater overtravel so that the operation of the contact is delayed from another normally closed contact during an opening operation, (R) designates a saving resistor which is connected in parallel to the normally closed contact (MC-b) of the auxiliary circuit breaker and (SW) designates a command switch placed outside.

The operation of the main circuit breaker is carried out as follows: When the command switch placed outside is turned-on, a current flows to (SW)-(MC-b)-(MC) to apply the full voltage to the operating coil (MC). A movable iron core (not shown) is attracted to close the main contact of the main circuit breaker, then the normally closed contact (MC-b) is opened to insert the saving resistor thereby passing a current through (SW)-(R)-(MC). As a result, a movable contact is attracted to the stationary contact to render the main contact of the main circuit breaker in closing condition. As well known, attractive force is great in the condition that the movable contact is attracted to the stationary contact whereby a sufficiently great attractive force is maintained even though voltage is shared by the saving resistor (R) and the operating coil (MC), respectively.

When the command switch (SW) is turned off to prevent the feeding of current, the movable contact detaches from the stationary contact, thus causing disconnection of the main contact of the main circuit breaker whereby the normally closed contact (MC-b) of the auxiliary contact returns to the original closed state because of the zero voltage.

The conventional auxiliary circuit breaker has the following disadvantage. When the normally closed contact (MC-b) is actuated to turn off the coil current of the main circuit breaker so as to apply shared voltage to the resistor (R) and the coil (MC) respectively, the attractive force of the movable iron core suddenly reduces because the normally closed contact (MC-b) is opened before the closing operation of the main contact of the main circuit breaker. The reduction in attractive force may cause unreliable contact operation of the main contact or a suspending state of the main contact at the crossing point (C) due to the chattering of the command switch (SW) or voltage drop because the attractive force is lower than repulsive force in same portion as it is clear from a repulsive-attractive force characteristic shown in FIG. 6. Thus, faults such as melting or adhesion of the main contact have occurred.

A cross bar (2) having a longer rectangular hole (10) has been proposed and practically used to delay the detachment of the normally closed contact (MC-b). The proposed circuit breaker has failed to eliminate completely the unreliable contact operation or the suspending state at crossing point (C) of the main contact because a gap for the contact is too small to prevent the interruption of the coil current.

SUMMARY OF THE INVENTION

It is an object of the present invention to overcome the disadvantage of the conventional circuit breaker and to provide an auxiliary circuit breaker which completely eliminates unreliable contact operation and a suspending state at a crossing point (C) of a main contact.

The foregoing and other objects of the present invention have been attained by providing an auxiliary circuit breaker actuated in response to a circuit breaker in a main circuit including a base for holding a plurality of stationary contacts, a plurality of movable contacts attached to and detached from the stationary contacts, a spring for imparting a predetermined force to each movable contact, a cross bar placed at the center of the base to be movable in the axial direction, and a cover placed in the front of the base, wherein an auxiliary cross bar is supported by the cover so that the auxiliary cross bar is actuated by the cross bar to move the movable contact from the closing state to the opening state depending upon the operation of the cross bar.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
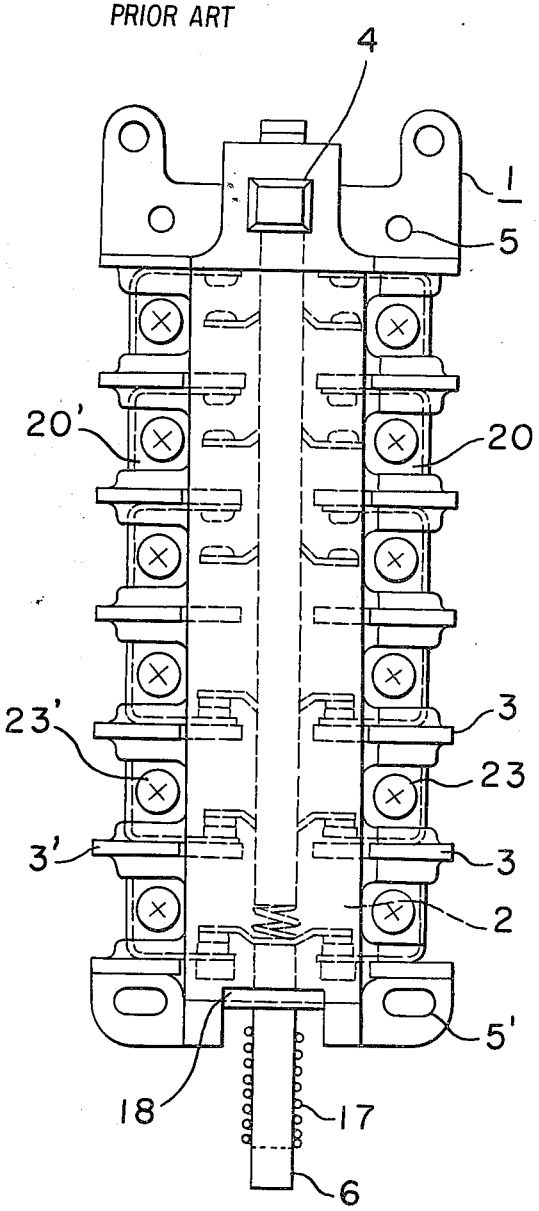
FIG. 1 PRIOR ART
FIG. 1 is a front view of the conventional auxiliary circuit breaker.
Figure 2:
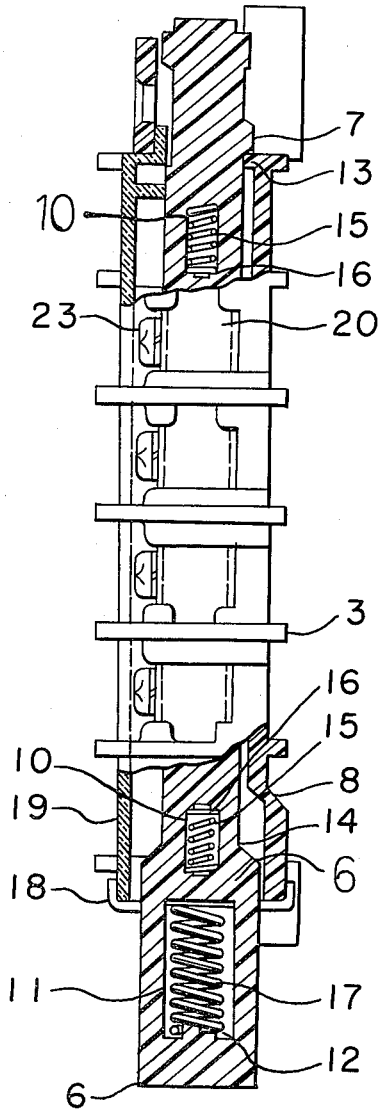
FIG. 2 PRIOR ART
FIG. 2 is a right side view, partly in cross-section of the circuit breaker shown in FIG. 1.
Figure 3:
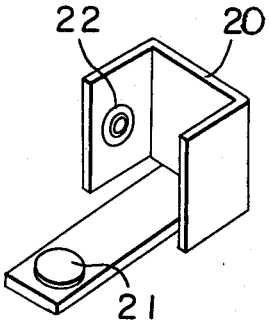
FIG. 3 PRIOR ART
FIG. 3 is a schematic view of the stationary contact of the conventional circuit breaker.
Figure 4:
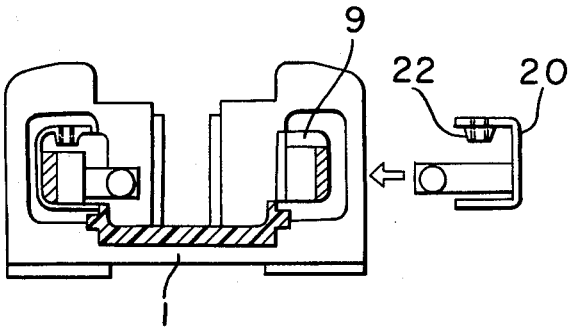
FIG. 4 PRIOR ART
FIG. 4 is a cross-sectional view of the circuit breaker shown in FIG. 1.
Figure 5:
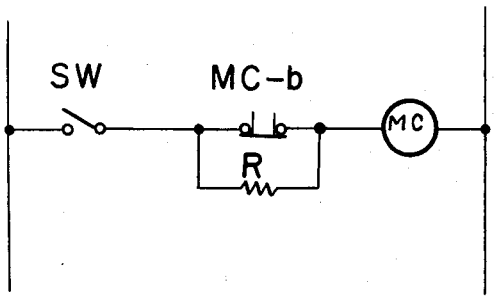
FIG. 5 PRIOR ART
FIG. 5 is a circuit diagram illustrating operation of a main circuit breaker.
Figure 6:
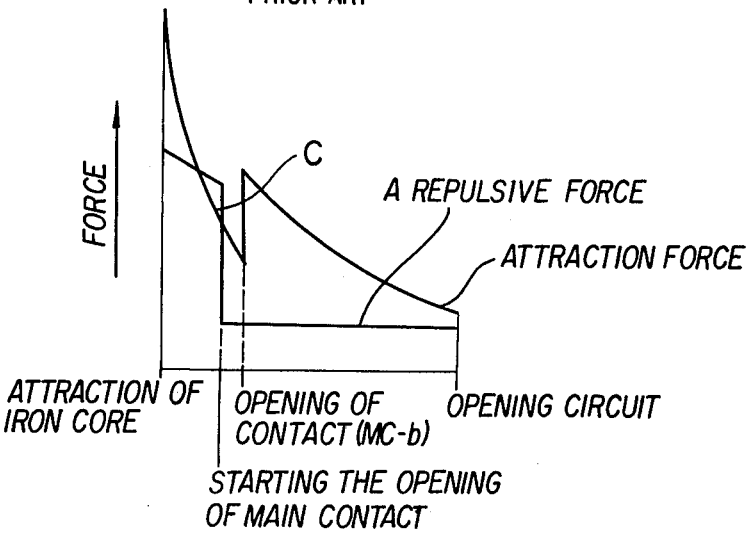
FIG. 6 PRIOR ART
FIG. 6 is a diagram showing attractive-repulsive force stroke characteristics.
Figure 7:
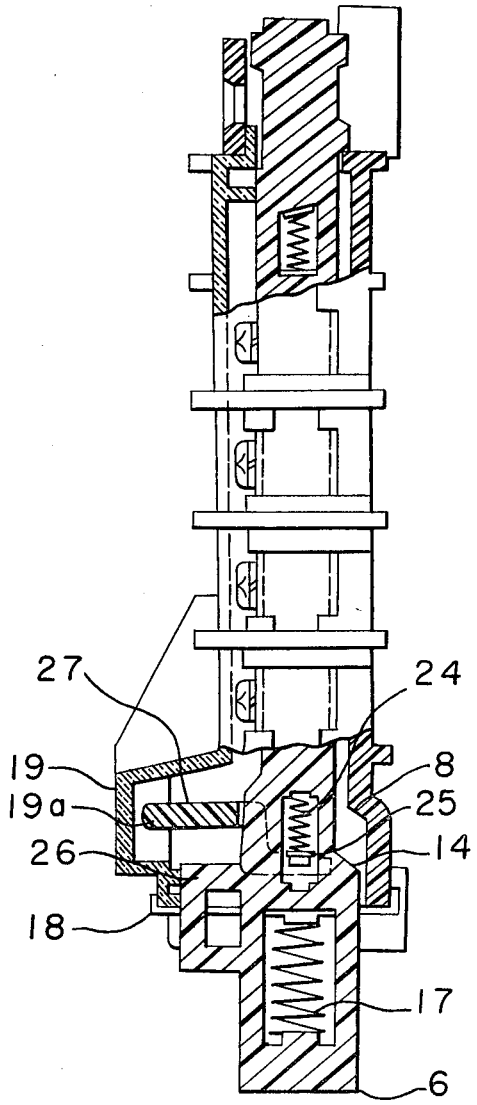
FIG. 7 is a right side view, partly in cross-section, of an embodiment of the auxiliary circuit breaker of the present invention.
Figure 11:
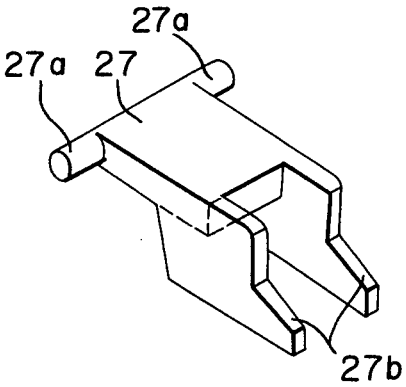
FIG. 11 is a schematic view of an embodiment of the auxiliary cross bar of the present invention.

Referring now to the drawings, wherein like reference numerals designate identical or corresponding parts throughout the several views, and more particularly to FIG. 7 thereof, a movable contact (25) is placed in the rectangular hole (10) of the cross bar (6) while being subjected to the spring action of the spring (24). A third projection (26) is formed on the cross bar (6) on the opposite side with reference to the second projection (14). A pair of supporting portions (19*a*) are formed in the dust-proof cover (19) so as to receive a pair of pivotal shafts (27*a*) of an auxiliary cross bar (27) formed by plastic molding so that the auxiliary cross bar can be turned around the pivotal points. The auxiliary cross bar (27) has a forked end portion (27*b*), as shown in FIG. 11, between which the cross bar (6) is clamped, the forked end portion (27*b*) serving as pushing plates (27) for raising the movable contact (25).

Figure 8A:
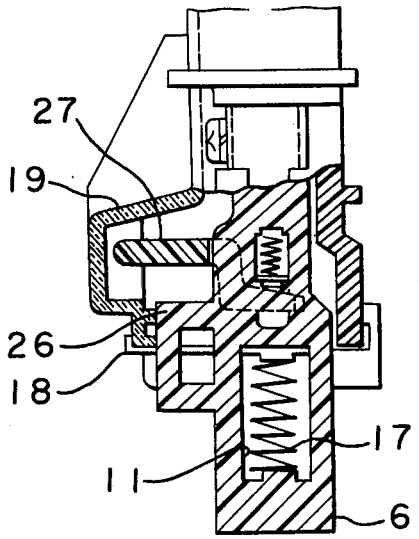
FIGS. 8 to 10 illustrate operations of the auxiliary circuit breaker shown in FIG. 7, wherein FIGS. 8(A), 9(A), and (10A) are respectively side views showing movements of an important part of the circuit breaker of FIG. 7 and FIGS. 8(B), 9(B) and 10(B) are respectively schematic views showing states of stationary and movable contacts.
Figure 8B:
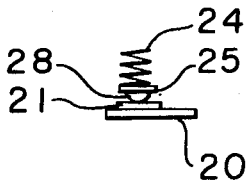
Figure 9A:
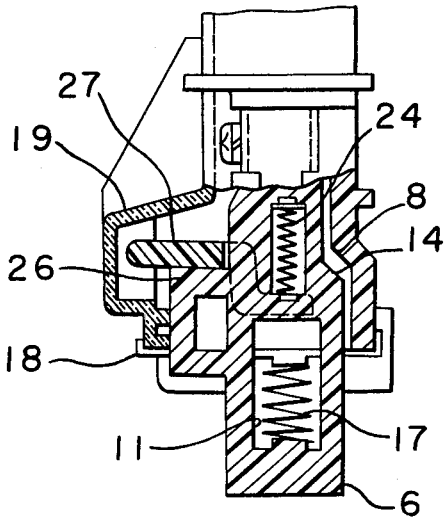
Figure 9B:
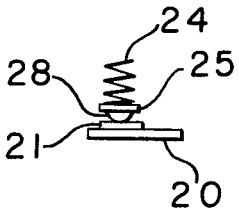
Figure 10A:
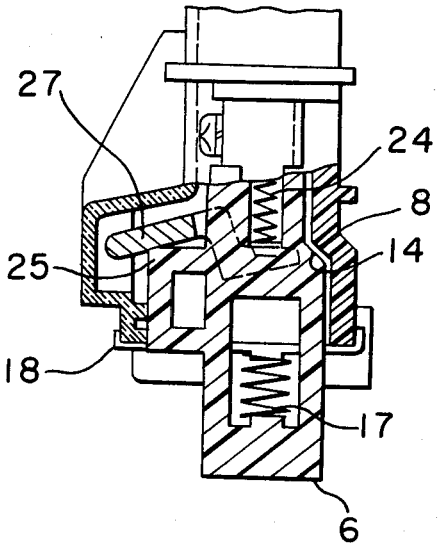
Figure 10B:
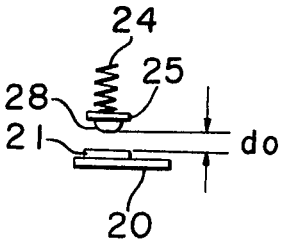
Figure 12:
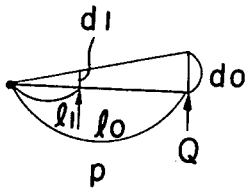
FIG. 12 is a diagram showing the operation of the auxiliary circuit breaker.

In the structure described above, when a main circuit breaker (not shown) is actuated from the opening state to the closed state, the auxiliary circuit breaker follows the operation of the main circuit breaker to move the cross bar (6) in the order of operation as shown in FIG. 8 through FIG. 10.

FIGS. 8A and 8B illustrate the normally closed contact (MC-b) in the closed state while the main circuit breaker is in the open state (not shown). The upper portion of the cross bar (6) is guided by the first stopper (7) of the base (1) and the cover (19). In this condition, the movable contact point (28) of the movable contact (25) is brought into contact with the stationary contact point (21) of the stationary contact (20) to activate the circuit. When the cross bar (6) is moved upward in response to the closing operation of a main circuit breaker (not shown), the third projection (26) of the cross bar (6) is brought into contact with the auxiliary cross bar (27) as shown in FIGS. 10(A) and (10)B to turn the auxiliary cross bar in the counterclockwise direction around the pivotal shafts (27*a*) of the auxiliary cross bar (27) which are received in the supporting portions (19*a*) of the cover (19). Turning of the auxiliary cross bar pushes up the movable contact (25) to provide the open state between the movable contact point (28) and the stationary contact point (21).

The operation of the cross bar (6) of the auxiliary circuit breaker actuating in response to the operation of the main circuit breaker from the closed state to the open state is illustrated in FIGS. 10, 9 and 8, the operation of the cross bar being reverse to the aforementioned operation from the open state to the closed state of the main circuit breaker.

The opening operation starting position of the conventional auxiliary circuit breaker will be compared with that of an embodiment of the present invention. The opening operation starting position of the normally closed contact (MC-b) of the conventional auxiliary circuit breaker is expressed by (D-do), while the opening operation starting position of the normally closed contact (MC-b) of the embodiment of the present invention is expressed by $$D - \frac{l_1 \cdot d_o}{l_o}$$

The opening-operation delaying effect of the normally closed contact (MC-b) of the auxiliary circuit breaker of the present invention can be expressed as follows.

$$D - \frac{l_1 \cdot d_o}{l_o} - (D - d_o) = \frac{d_o(l_o - l_1)}{l_o}$$

wherein D: cross bar stroke, $d_o$: the distance of opening path of the normally closed contact (MC-b) (the gap between contact point), $l_o$: the distance between the supporting portion and the center of the cross bar, $\mathbf{1}_1$: the distance between the supporting point and the third projection 26.

Briefly, in accordance with the present invention, an auxiliary cross bar is provided in an auxiliary circuit breaker so that the distance of operation of the cross bar is expanded (widened) just before the final position to delay the circuit-opening operation of a normally closed contact (MC-b) thereby opening the circuit after the starting of closing the main contact of a main circuit breaker. With this structure, unreliable contact operation and the suspending state of the main contact caused by balance of attractive force to reactive force when the main contact of the main circuit breaker is opened can be eliminated to improve reliability of the main circuit breaker.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An auxiliary circuit breaker actuated in response to the operation of a main circuit breaker, comprising:

a base for holding at least one stationary contact;

a cross bar defining a longitudinal direction and adapted to be coupled to said main circuit breaker, said cross bar placed at the center of said base to be movable in the longitudinal direction upon movement of said main circuit breaker;

at least one movable contact mounted on said cross bar and detachable from said at least one stationary contact upon selected movement of said cross bar in the longitudinal direction;

a spring coupled to said cross bar for imparting a predetermined force to bias said at least one movable contact into contact with said at least one stationary contact;

a stationary cover coupled to said base and covering said movable and stationary contacts; and, an auxiliary cross bar supported by said cover and coupled to said cross bar so that the auxiliary cross bar is actuated by said cross bar to move said at least one movable contact from a closed state in contact with said at least one stationary contact to an open state not in contact with said at least one stationary contact depending upon the operation of said cross bar, said auxiliary cross bar comprising one end pivotably coupled to said cover and an opposite end coupled to said movable contact for increasing the distance of operation of said movable contact.

2. An auxiliary circuit breaker according to claim 1 wherein said cross bar comprises:

a projection by which said auxiliary cross bar is raised upward depending upon the upward movement of said cross bar.

3. An auxiliary circuit breaker according to claim 1 wherein the opposite end of said auxiliary cross bar comprises:

a forked end portion between said cross bar is clamped.

4. An auxiliary circuit breaker according to claim 1 wherein:

said pivotably coupled end of said auxiliary cross bar comprises a pair of pivotal shafts for enabling pivoting of said auxiliary cross bar; and said cover comprises a pair of supporting portions so as to receive said pair of pivotal shafts so that the auxiliary cross bar is turned.

* * * * *